United States Patent [19]

Gallusser et al.

[11] 4,275,948

[45] Jun. 30, 1981

[54] ELECTRICAL CONTACT AND METHOD FOR MAKING SAME

[75] Inventors: David O. Gallusser, Oneonta; Valentine J. Hemmer, Sidney; Gary C. Toombs, New Berlin, all of N.Y.

[73] Assignee: The Bendix Corporation, Southfield, Mich.

[21] Appl. No.: 71,466

[22] Filed: Aug. 31, 1979

[51] Int. Cl.[3] ..... H01R 13/12

[52] U.S. Cl. ..... 339/218 R; 29/874; 264/272; 264/274; 339/278 D

[58] Field of Search ..... 339/218 R, 218 M, 278 C, 339/278 D, 256 R, 275 T; 29/874, 882, 883, 885; 264/272, 274

[56] References Cited

U.S. PATENT DOCUMENTS

| | | | |
|---|---|---|---|
| 2,691,771 | 10/1954 | Burtt et al. | 339/275 T |
| 2,906,986 | 9/1959 | Schaefer | 339/218 R |
| 3,061,503 | 10/1962 | Gould et al. | 339/218 R |
| 3,487,353 | 12/1969 | Massa | 339/218 R |
| 3,543,227 | 11/1970 | Moulin | 339/256 R |
| 4,114,976 | 9/1978 | Selvin et al. | 339/218 M |

FOREIGN PATENT DOCUMENTS

| | | | |
|---|---|---|---|
| 1380706 | 1/1975 | United Kingdom | 339/218 R |

*Primary Examiner*—Neil Abrams

*Attorney, Agent, or Firm*—Paul J. Ethington; Raymond J. Eifler; Charles D. Lacina

[57] ABSTRACT

An electrical contact, for use in pin and socket type connectors, is fabricated as a unitary, composite body of metal and plastic. The contact (10) comprises a tubular body (12) having a wire receiving end (16) and a mating end (14). The composite tubular body (12) includes a sleeve (18) of wire cloth which is impregnated to form multiple islands (32) of plastic between the wires (34) on the internal surface and a plastic jacket (24) on the external surface. The contact fingers (22) are surrounded by a plastic hood (40) which provides a closed entry (42) for guiding a mating pin contact (44). The socket contact (10) is fabricated by stamping wire cloth to form a sleeve blank (18') and rolling the blank to form the sleeve (18). The sleeve (18) is fitted with core members (60) and (62) and placed in a mold cavity for injection molding of the plastic.

12 Claims, 7 Drawing Figures

ELECTRICAL CONTACT AND METHOD FOR MAKING SAME

TECHNICAL FIELD

This invention relates to electrical connectors of the plug and receptacle type; more particularly, it relates to electrical contacts and a method of making such contacts.

BACKGROUND OF THE INVENTION

Electrical connectors of the plug and receptacle type are used in many applications for connecting multiple pairs of corresponding conductors. Such connectors are widely used in the aerospace field in complex electronic systems in which a single connector may interconnect many pairs of wires. In such systems, the connectors must be miniaturized to minimize the weight and size. The wires at the receptacle are connected to individual terminals and the wires at the plug are connected to corresponding terminals. Each of the terminals on one of the connector members is a socket contact and each of the terminals on the other member is a pin contact which is adapted to telescopically engage the corresponding socket contact when the plug and receptacle are in mated relationship. In order to miniaturize the connector, the pin and socket contacts need to be very small; for example, the socket contact may be less than one-tenth inch diameter and less than one-half inch long.

Connectors of the type described must be capable of quick and easy connection and disconnection without undue force. Yet each set of contacts must provide excellent electrical conductivity and be capable of repeated connection and disconnection without damage or significant deterioration. When miniature contacts were first introduced, they were manufactured by machining metal stock since that was the only feasible way to hold the tolerances required for mating contacts. However, machined contacts are relatively costly. In recent years such contacts have been made from sheet metal by forming and rolling to produce a "formed'-'contact.

Formed socket contacts have been developed which comprises an assembly of a contact sleeve or liner of spring metal having plural contact fingers at the mating end and a front hood or sleeve around the fingers providing a tapered entry for guiding a mating pin contact. The wire receiving end has a supporting sleeve thereon and is crimped into engagement with the wire. The contact fingers constitute cantilevers which are deflected in a radial direction by the insertion of the mating pin contact. Each of the contact fingers is supported only at its root in the contact sleeve. In order to insure a good electrical connection between the socket contact and the pin contact, it is necessary to have each finger exert an appropriate resisting force to radial deflection. Additionally, a mounting flange is provided in the midsection of the contact. A socket contact of this construction and method of making it are described in U.S. Pat. No. 4,072,394 granted Feb. 7, 1978 to Waldron et al. and assigned to the same assignee as this application.

Although the prior art contacts, of the type discussed above are very satisfactory in design and performance, they are fabricated from several metal pieces and are relatively costly to manufacture.

A general object of this invention is to provide an improved electrical contact of the type described which overcomes certain problems of the prior art.

DISCLOSURE OF THE INVENTION

According to this invention, an electrical contact is provided which exhibits improved design and performance characteristics and which affords cost savings in manufacture. The contact is resistant to the effects of moisture and exhibits high dielectric strength. Additionally, gold or silver plating of the contact surface to enhance the conductivity thereof can be done with reduced quantity of plated metal.

This is accomplished by a contact having a unitary, composite body of metal and plastic. A tubular body of foraminous metal, preferably wire cloth is formed to provide the body with a wire receiving end and a mating end. The foraminous metal is impregnated with plastic to fill the interstices; the electrical contact surface is kept free of plastic except in the interstices while the opposite surface of the metal is coated with the plastic to provide strength and a protective jacket. The exposed metal of the contact surface is electroplated to enhance the electrical conductivity thereof. In a socket contact, a plastic sleeve integral with the plastic jacket extends coaxially of the contact fingers and provides a closed entry for guiding a mating pin contact. Also, a plastic annular flange integral with said jacket is provided on the body between the mating end and the wire receiving end. A plastic core may be provided inside the tubular body between the contact fingers and the wire receiving end to serve as a wire stop and to provide structural reinforcement for the body.

BEST MODE FOR CARRYING OUT THE INVENTION

Figures 1, 1A, 2, 3, 4:
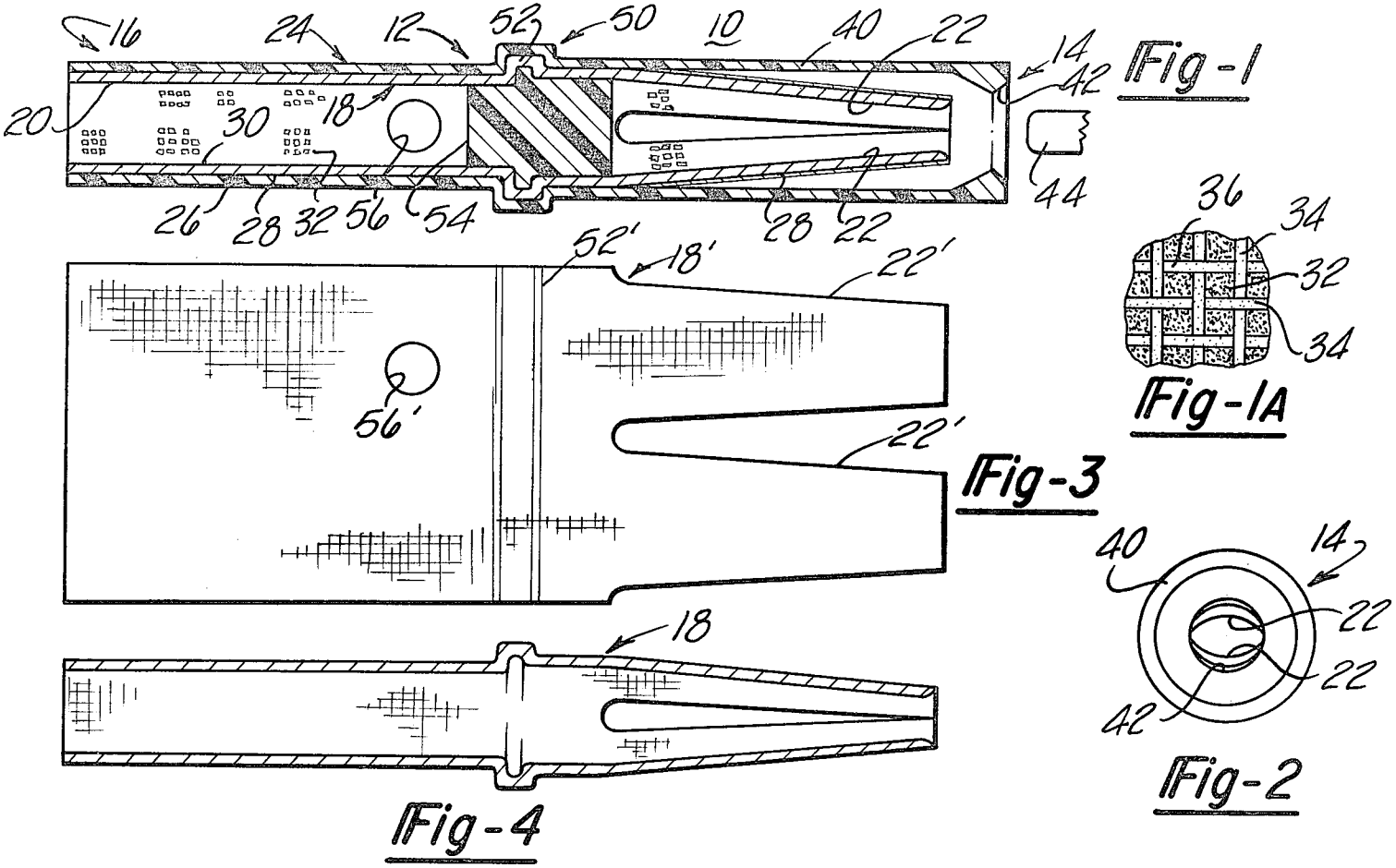
FIG. 1 shows the socket contact of this invention in cross-sectional view.
FIG. 1A shows a detail of construction.
FIG. 2 shows an end view of the contact of FIG. 1.
FIG. 3 shows a flat piece of wire cloth from which part of the contact is fabricated.
FIG. 4 shows the metal part of the contact after being formed from the piece shown in FIG. 3.

Referring now to the drawings, there is shown an illustrative embodiment of the invention in a socket contact especially adapted for use in separable electrical connectors. The socket contact comprises a contact sleeve or liner of formed metal i.e. it is fabricated from a thin sheet of foraminous metal, such as wire cloth, by stamping and rolling. The contact is adapted for mounting in a dielectric insert of an electrical connector member and for telescopic engagement with a pin contact mounted on a mating connector member. As the description proceeds, it will be appreciated that the invention is useful in other embodiments.

The illustrative embodiment of the invention in a socket contact is shown in FIG. 1. In general, the socket contact 10 comprises a tubular body 12 having a mating end 14 and a wire receiving end 16. The tubular body 12 is a composite body which comprises a foraminous metal, preferably a wire cloth of fine mesh and a plastic which will be described subsequently. The tubular body includes a metal sleeve 18 of wire cloth having a cylindrical portion 20 at the rear or wire receiving end and having a pair of circumferentially spaced, axially extending contact fingers 22 at the forward or mating end 14. The metal sleeve 18 is a wire cloth which is woven of metal wires, which may be beryllium-copper or other copper alloy. The wires may be a few thousandths of an inch in diameter and the interstices or mesh of the cloth may be about the same size.

The tubular composite body 12, as stated above also comprises a plastic which is combined with the foraminous metal sleeve 18. The plastic is used as a coating and as an impregnant or filler for the interstices of the metal sleeve to provide structural reinforcement, protection and desired dimensional characteristics. Furthermore, the plastic is used for structural members without any encapsulated portion of the metal sleeve but with such structural members being integrally joined with the plastic of the composite body. The plastic is preferably formed and joined with the metal sleeve by molding, as will be described subsequently. The plastic is preferably polytetrafluoroethylene (Teflon); however other plastics, such as polypropylene, may be satisfactory depending upon the application of the contacts.

As shown in FIGS. 1 and 2, a plastic jacket 24 is coextensive with the metal sleeve 18 or the exterior surface. A relatively thick coating or layer 26 is disposed on the cylindrical portion thereof and a relatively thin layer 28 is disposed on the contact fingers 22. The interstices or openings of the wire cloth of sleeve 18 are impregnated or filled with the plastic of the jacket 24 from the outer surface 28 of the sleeve to the inner surface 30 thereof. The inner surface 30 of the sleeve is kept free of the plastic material except where it resides in the openings or mesh thereof. Accordingly, there are a multiplicity of localized areas or islands 32 of plastic separated by the metal wires 34 of the sleeve 18, as shown in FIG. 1A. In order to enhance the conductivity of the inner surface 30 of the composite tubular body 12, a thin layer 36 of metal, preferably gold, is applied by electroplating to the inner surfaces of the wires 34.

The contact 10 also comprises an outer sleeve or front hood 40 of plastic, the same as that of the jacket 24. The front hood 40 is a cylindrical sleeve extending coaxially of the contact fingers 22 to a point beyond the forward ends thereof. The front hood 40 terminates in a so-called closed entry or circular opening 42 for guiding a mating pin contact 44 into the contact fingers 22. It is noted that the front hood 40 is formed integrally with the plastic jacket 24.

The contact 10 also includes an annular mounting flange 50 between the mating end 14 and the wire receiving end 16. The flange 50 is formed in the wall of the tubular body 12 and includes an annular flange or embossment 52 in the metal sleeve 18 which is coated by a portion of the plastic jacket 24. A plastic core or plug 54 is disposed inside the tubular composite body 12 between the mating end 14 and the wire receiving end 16. The plug 54 serves as a wire stop in the contact 10 and also serves to reinforce the structure of the tubular body 12. An inspection hole 56 is provided in the wall of the composite body behind the wire stop 54. The wire receiving end 16 of the contact is adapted to receive the end of a wire (not shown) in the cylindrical portion 20 against the wire stop 54 and the cylindrical portion 20 of the composite tubular body 12 is adapted to be crimped against the wire to retain it in place. The contact 10 is adapted to be mounted in a connector member in a known manner in which the mounting shoulder 50 coacts with retention means in the connector for holding the contact in place. The operation of the contact 10, the manner of connecting a wire thereto and installing the contact in a connector is the same as that disclosed in the aforementioned U.S. Pat. No. 4,072,394.

The method of making the contact 10 will now be described with reference to FIGS. 3, 4, 5, 6 and 7. FIG. 3 illustrates the metal sleeve blank 18' from which the metal sleeve 18 is formed. The sleeve blank 18' is suitably stamped or die cut from a sheet of wire cloth to provide a rectangular portion with plural fingers 22' extending therefrom. Also, the inspection hole 56' is cut. While the blank 18' is flat, it is embossed by a die to form the shoulder or embossment 52'. The sleeve blank 18' is rolled about its longitudinal axis to form a cylindrical tube. While in the tubular form, the fingers 22' are bent or preformed inwardly so that they are convergent at the outer ends. The formed sleeve 10 is shown in FIG. 4.

Figure 7:
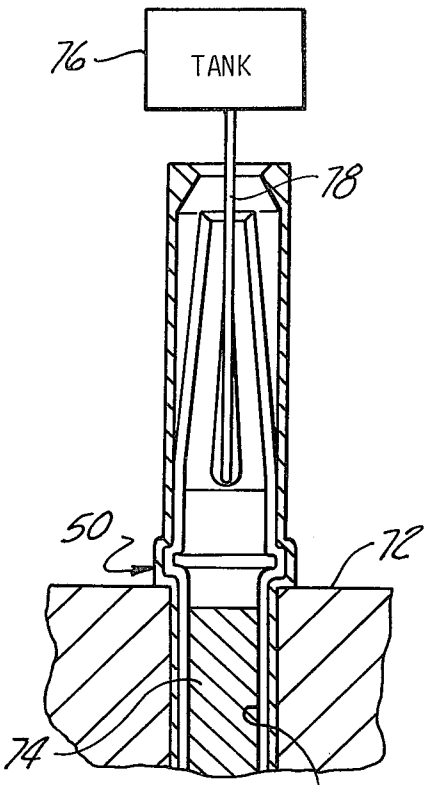
FIG. 7 illustrates apparatus for filling a part of the contact with a plastic core.
Figure 5:
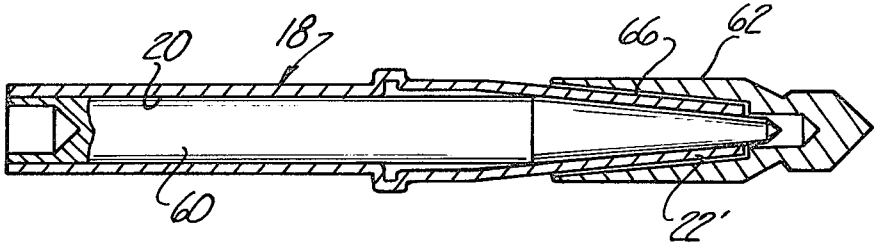
FIG. 5 shows the metal part of FIG. 4 together with mold members used in making the contact.
Figure 6:
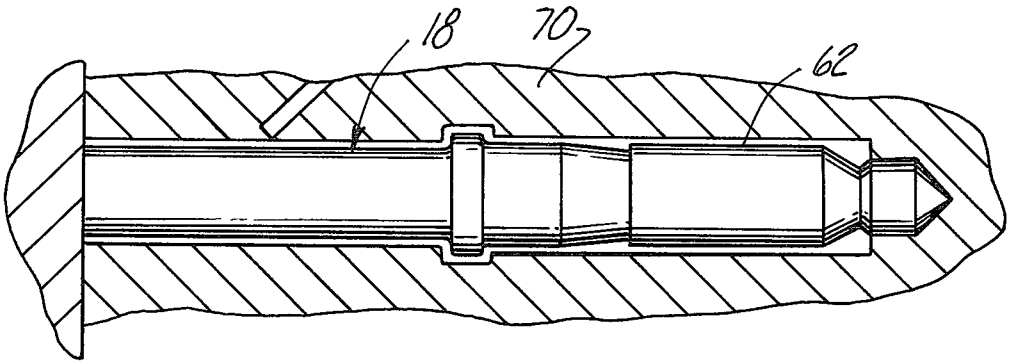
FIG. 6 shows the contact part in a mold cavity.

The composite tubular body 12, as depicted in FIG. 1, is made by joining the metal sleeve 18 with plastic in a molding operation. As shown in FIG. 5, a steel bushing or core pin 60 is inserted inside the metal sleeve 18. It is noted that the core pin 60 is in close engagement with the cylindrical portion 20 of the sleeve 18 and also in close engagement with the fingers 22. However, a small annular space remains between the core pin and the sleeve 18 in the region between the fingers 22 and the cylindrical portion 20. A bushing or core member 62, suitably of zinc is disposed over the contact fingers 22'. A plurality of spacer lands (not shown) on the inner surface of the member 62 maintains a small annular space 66 between the core member 62 and the contact fingers 22. Further, a pair of internal lands (not shown) on the core member 62 are disposed between the fingers 22' and fill the space therebetween. As shown in FIG. 6, the metal sleeve 18 after being fitted with the core pin 60 and the core member 62, is disposed in the mold cavity of an injection molding machine 70. The plastic is injected into the cavity in contact with the entire external surface of the metal sleeve 18. This impregnates the interstices of the metal sleeve 18 and applies a coating of plastic over the external surface of the metal sleeve 18. The molten plastic is blocked from reaching the innermost surfaces of the metal sleeve 18 by the engagement of the core pin 60 with the sleeve 18. After the molded body is removed from the die cavity, the core pin 60 is mechanically extracted and the core member 62 is removed chemically, as by an etching bath. The composite body 12 is completed as illustrated in FIG. 7 by placing it in a fixture 72 in a vertical position with a plug 74 extending through the cylindrical portion 20 to a point adjacent the shoulder 50. A measured quantity of molten plastic is supplied to the interior of the tubular body 12 from a container 76 through a tube 78. In this manner, the plastic core 54 (see FIG. 1) is provided inside the tubular body 12.

Although the description of this invention has been given with reference to a particular embodiment it is not to be construed in a limiting sense. Many variations and modifications will now occur to those skilled in the art. For a definition of the invention reference is made to the appended claims.

What is claimed is:

1. For use in an electrical connector of the type including at least one pair of pin and socket contacts, a socket contact comprising a tubular body having a foraminous metal wall defining inner and outer electrically conductive contact surfaces with the interstices thereof impregnated with plastic and the wall outer contact surface being coated by said plastic, said tubular body having a wire receiving end and a mating end having plural contact fingers, said mating end including an electrically conductive contact surface adapted to engage a conductive surface of a mating contact, the conductive surface being free of said plastic except for islands of plastic in said interstices and a plastic sleeve disposed coaxially of said contact fingers and being spaced radially therefrom, said sleeve terminating at its front and forwardly of said fingers and defining an opening coaxial therewith to provide a closed entry for guiding a pin contact into said contact fingers.

2. The invention as defined in claim 1 including a coating of electrodeposited metal on said conductive surface.

3. The invention as defined in claim 1 wherein said tubular body includes an external annular flange of plastic between said mating end and said wire receiving end for mounting said contact.

4. The invention as defined in claim 1 including a plastic core inside said tubular body between said mating end and said wire receiving end.

5. The method of making an electrical socket type contact comprising the steps of cutting from a foraminous metal sheet a flat piece having a rear portion and a front portion which includes plural fingers, rolling the flat piece to form a tubular body having a tubular wire receiving end at the rear portion and a mating end at the front portion with plural, circumferentially spaced, axially extending fingers, embossing a transverse channel in said flat piece between said rear portion and said front portion extending transversely of said fingers whereby it becomes an annular metal flange, molding a plastic jacket around the outer surface of said tubular body, molding a plastic flange on said transverse channel integral with said plastic jacket, blocking said plastic from the inner surface of said tubular body, whereby the plastic impregnates the foraminous metal sheet of the body to provide an inner surface thereof which is partially metal and partially plastic and whereby the body is electrically conductive from one end to the other.

6. The invention as defined in claim 5 wherein said foraminous metal sheet is a wire cloth.

7. The invention as defined in claim 5 including the step of bending said fingers inwardly so that they are convergent at the front end thereof.

8. The invention as defined in claim 7 including the step of molding a plastic sleeve in spaced relation around said fingers as an integral extension of said jacket.

9. The invention as defined in claim 8 including the step of molding an annular flange as an integral part of said jacket between said wire receiving end and said mating end.

10. The method of making an electrical socket type contact comprising the steps of cutting from a foraminous metal sheet a flat piece having a rear portion and a front portion which includes plural fingers, rolling the flat piece to form a tubular body having a tubular wire receiving end at the rear portion and a mating end at the front portion with plural, circumferentially spaced, axially extending fingers convergent towards each other at the front end, placing a metal bushing over said fingers with annular space between the bushing and said fingers, molding a plastic jacket around the outer surface of said tubular body, said step of molding includes placing said metal body in a mold cavity and injecting plastic into said cavity, said bushing having an outer diameter less than that of said mold cavity whereby a plastic sleeve is formed around said fingers separated therefrom by said bushing, blocking said plastic from the inner surface of said tubular body, said step of blocking includes placing a core pin inside said tubular body, whereby the plastic impregnates the foraminous metal sheet of the body to provide an inner surface thereof which is partially metal and partially plastic and whereby the body is electrically conductive from one end to the other.

11. The invention as defined in claim 10 including the step of removing said bushing by chemical etching thereof.

12. The invention as defined in claim 11 including the step of placing a plug in said tubular wire receiving end and putting moten plastic through the mating end onto said plug to form a plastic core in said body in the vicinity of said annular flange, and removing said plug.

* * * * *